US010641487B2

(12) United States Patent
Haussner

(10) Patent No.: US 10,641,487 B2
(45) Date of Patent: May 5, 2020

(54) PRESSURE MEASURING GLOW PLUG

(71) Applicant: BorgWarner Ludwigsburg GmbH, Ludwigsburg (DE)

(72) Inventor: Michael Haussner, Benningen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 273 days.

(21) Appl. No.: 15/672,406

(22) Filed: Aug. 9, 2017

(65) Prior Publication Data

US 2018/0045412 A1 Feb. 15, 2018

(30) Foreign Application Priority Data

Aug. 11, 2016 (DE) ..... 10 2016 114 929

(51) Int. Cl.
*F23Q 7/00* (2006.01)

(52) U.S. Cl.
CPC ..... *F23Q 7/001* (2013.01); *F23Q 2007/005* (2013.01)

(58) Field of Classification Search
CPC .. G01M 15/08; F23Q 7/001; F23Q 2007/005; F23Q 2007/002; F23Q 7/00
USPC ..... 219/270, 541, 544; 123/145 A; 73/114.16, 114.19, 115
See application file for complete search history.

(56) References Cited

U.S. PATENT DOCUMENTS 2,672,546 A * 3/1954 Klingner ..... F23Q 7/001 219/270
4,211,204 A * 7/1980 Glauner ..... F23Q 7/001 123/145 A
4,636,614 A * 1/1987 Itoh ..... F23Q 7/001 123/145 A
4,661,686 A * 4/1987 Yokoi ..... F23Q 7/001 123/145 A
4,725,711 A * 2/1988 Minegishi ..... F23Q 7/001 123/145 A
4,846,736 A 7/1989 Powers et al.
4,914,274 A * 4/1990 Hatanaka ..... F23Q 7/001 123/145 A
6,255,626 B1 * 7/2001 Endler ..... F23Q 7/001 219/270
6,359,261 B1 * 3/2002 Watanabe ..... C04B 35/593 219/270

(Continued)

FOREIGN PATENT DOCUMENTS

DE 9210735 U1 * 12/1993 ..... F02P 19/028
DE 9210735 U1 12/1993

(Continued)

*Primary Examiner* — Jimmy Chou
(74) *Attorney, Agent, or Firm* — Bose McKinney & Evans LLP

(57) ABSTRACT

Described is a pressure measuring glow plug with a housing, a glow pin, which projects out of the housing and can be displaced in its longitudinal direction relative to the housing against a restoring force. A sensor acquires the position of the glow pin or a pressure acting on the glow pin, and a center pole is arranged in the housing and electrically connected to the glow pin via a contact spring. This disclosure provides that the contact spring is a U-shaped, bent metal strip, which in a middle section has a reduced width, and broadens from the middle section toward its two ends.

11 Claims, 4 Drawing Sheets

(56) References Cited

U.S. PATENT DOCUMENTS 6,433,311 B1 * 8/2002 Teramura ..... F23Q 7/001 219/270
6,563,089 B2 * 5/2003 Watanabe ..... C04B 35/5626 123/145 A
6,737,612 B2 * 5/2004 Taniguchi ..... F23Q 7/001 123/145 A
6,881,930 B2 * 4/2005 Yoshikawa ..... F23Q 7/001 123/145 A
6,900,412 B2 * 5/2005 Taniguchi ..... F23Q 7/001 219/270
7,034,253 B2 * 4/2006 Yoshikawa ..... F23Q 7/001 123/145 A
7,705,273 B2 * 4/2010 Hotta ..... F23Q 7/001 219/260
8,003,917 B2 * 8/2011 Kern ..... F23Q 7/001 219/260
8,378,273 B2 * 2/2013 Sekiguchi ..... H05B 3/141 219/270
8,389,904 B2 * 3/2013 Pottiez ..... F23Q 7/001 123/179.6
8,459,104 B2 * 6/2013 Cheng ..... F02P 19/028 73/114.19
8,567,237 B2 * 10/2013 Maeda ..... G01L 23/08 73/114.18
8,893,545 B2 * 11/2014 Nakamura ..... G01M 15/08 73/114.19
8,966,963 B2 * 3/2015 Fukui ..... F23Q 7/001 73/114.19
9,422,913 B2 * 8/2016 Okinaka ..... F02P 19/028
9,625,150 B2 * 4/2017 Pottiez ..... F02P 19/00
9,777,618 B2 * 10/2017 Akase ..... F02P 5/04
9,891,138 B2 * 2/2018 Hirokawa ..... F23Q 7/001
10,113,744 B2 * 10/2018 Takatsu ..... H05B 3/48
10,253,982 B2 * 4/2019 Suzuki ..... F23Q 7/001
2002/0043524 A1 * 4/2002 Taniguchi ..... F02P 17/12 219/270
2002/0060214 A1 * 5/2002 Chiba ..... F23Q 7/001 219/270
2002/0113052 A1 * 8/2002 Watanabe ..... C04B 35/5603 219/270
2002/0134774 A1 * 9/2002 Funaki ..... C04B 35/584 219/270
2002/0148823 A1 * 10/2002 Watanabe ..... C04B 35/5626 219/270
2002/0162830 A1 * 11/2002 Taniguchi ..... F23Q 7/001 219/270
2002/0162831 A1 * 11/2002 Taniguchi ..... F23Q 7/001 219/270
2002/0162834 A1 * 11/2002 Asano ..... F23Q 7/001 219/541
2002/0175155 A1 * 11/2002 Funaki ..... C04B 35/584 219/270
2002/0175156 A1 * 11/2002 Hotta ..... F02P 19/028 219/270
2003/0029856 A1 * 2/2003 Tatematsu ..... F23Q 7/001 219/270
2003/0029857 A1 * 2/2003 Taniguchi ..... F23Q 7/001 219/270
2003/0042243 A1 * 3/2003 Taniguchi ..... F23Q 7/001 219/270
2003/0126736 A1 * 7/2003 Watanabe ..... F23Q 7/001 29/611
2004/0026399 A1 * 2/2004 Taniguchi ..... F23Q 7/001 219/270
2004/0178185 A1 * 9/2004 Yoshikawa ..... F23Q 7/001 219/270
2004/0182144 A1 * 9/2004 Okazaki ..... F02P 19/028 73/114.18
2004/0182145 A1 * 9/2004 Okazaki ..... F02P 19/028 73/114.18
2005/0274707 A1 * 12/2005 Matsubara ..... F23Q 7/001 219/270
2005/0284859 A1 * 12/2005 Konishi ..... F23Q 7/001 219/270
2005/0284860 A1 * 12/2005 Yoshikawa ..... F23Q 7/001 219/270
2006/0011602 A1 * 1/2006 Konishi ..... F23Q 7/00 219/270
2006/0032472 A1 * 2/2006 Yamada ..... F23Q 7/001 123/145 A
2006/0053875 A1 * 3/2006 Haussner ..... F23Q 7/001 73/114.19
2007/0095811 A1 * 5/2007 Last ..... F23Q 7/001 219/270
2007/0210053 A1 * 9/2007 Hotta ..... F23Q 7/001 219/270
2007/0277617 A1 * 12/2007 Wolfer ..... G01L 23/22 73/723
2007/0289960 A1 * 12/2007 Tanaka ..... F23Q 7/001 219/383
2007/0295710 A1 * 12/2007 Yamada ..... F23Q 7/001 219/270
2008/0028841 A1 * 2/2008 Ludwig ..... G01L 23/10 73/114.76
2008/0302323 A1 * 12/2008 Kern ..... G01L 23/22 123/145 A
2009/0008383 A1 * 1/2009 Kurono ..... F23Q 7/001 219/553
2009/0165739 A1 * 7/2009 Kern ..... F23Q 7/001 123/145 R
2009/0194519 A1 * 8/2009 Funaki ..... F23Q 7/001 219/270
2009/0242540 A1 * 10/2009 Itoh ..... F23Q 7/001 219/267
2009/0314061 A1 * 12/2009 Kern ..... F23Q 7/001 73/35.12
2009/0321408 A1 * 12/2009 Kern ..... F23Q 7/001 219/270
2010/0059496 A1 * 3/2010 Rena ..... F02P 19/02 219/270
2010/0212621 A1 * 8/2010 Ramond ..... F23Q 7/001 123/145 R
2011/0048356 A1 * 3/2011 Merelle ..... F23Q 7/001 123/145 A
2011/0056925 A1 * 3/2011 Haussner ..... F23Q 7/001 219/270
2011/0114622 A1 * 5/2011 Sekiguchi ..... F23Q 7/001 219/270
2011/0240625 A1 * 10/2011 Takenouchi ..... F23Q 7/001 219/260
2011/0240629 A1 * 10/2011 Wulff ..... F02D 35/023 219/270
2013/0042831 A1 * 2/2013 Nishiyuki ..... F23Q 7/001 123/145 A
2013/0248508 A1 * 9/2013 Ito ..... F23Q 7/001 219/270
2013/0312691 A1 * 11/2013 Harada ..... F23Q 7/001 123/145 A
2013/0313244 A1 * 11/2013 Matsui ..... H05B 3/44 219/270
2013/0319094 A1 * 12/2013 Nakamura ..... G01M 15/08 73/114.19
2014/0138373 A1 * 5/2014 Takatsu ..... F02P 19/026 219/270
2014/0283586 A1 9/2014 Berkel et al.
2014/0339214 A1 * 11/2014 Ruthmann ..... F23Q 7/001 219/270
2014/0352640 A1 * 12/2014 Okinaka ..... F02P 19/028 123/145 A
2014/0373799 A1 * 12/2014 Suzuki ..... F23Q 7/00 123/145 A
2015/0013633 A1 * 1/2015 Wolff ..... F23Q 7/001 123/145 A
2015/0014302 A1 * 1/2015 Ikai ..... H05B 3/48 219/544
2015/0047592 A1 * 2/2015 Watanabe ..... G01L 23/221 123/145 A

(56) References Cited

U.S. PATENT DOCUMENTS

| | | | | |
|---|---|---|---|---|
| 2015/0048066 | A1* | 2/2015 | Maeda | F23Q 7/001 219/121.64 |
| 2015/0075473 | A1* | 3/2015 | Osawa | F02P 19/021 123/145 A |
| 2015/0136054 | A1* | 5/2015 | Wolff | F23Q 7/001 123/145 A |
| 2015/0300643 | A1* | 10/2015 | Takatsu | F23Q 7/001 219/209 |
| 2016/0061683 | A1* | 3/2016 | Nishiyuki | F23Q 7/001 73/114.19 |
| 2016/0076971 | A1* | 3/2016 | Hirokawa | F23Q 7/001 73/114.18 |
| 2016/0102649 | A1* | 4/2016 | Ohtani | F02P 19/028 123/145 A |
| 2017/0038069 | A1* | 2/2017 | Takatsu | F23Q 7/00 |
| 2018/0119956 | A1* | 5/2018 | Haussner | F23Q 7/22 |

FOREIGN PATENT DOCUMENTS

| | | | | |
|---|---|---|---|---|
| DE | 10249408 | A1 | | 6/2003 |
| EP | 2781903 | A1 | | 9/2014 |
| EP | 3006830 | A1 | | 4/2016 |
| JP | 2005-207721 | | * | 8/2005 |

* cited by examiner

PRESSURE MEASURING GLOW PLUG

RELATED APPLICATIONS

This application claims priority to DE 10 2016 114 929.2, filed Aug. 11, 2016, the entire disclosure of which is hereby incorporated herein by reference in its entirety.

BACKGROUND

The invention relates to a pressure measuring glow plug. In pressure measuring glow plugs, the glow pin can move relative to the plug housing through exposure to the combustion chamber pressure. The higher the combustion chamber pressure, the further the glow pin is pushed into the housing. The pressure acting on the glow pin or the pressure-dependent position of the glow pin relative to the housing is acquired with a sensor, for example with a piezoelectric sensor or a strain gauge.

In such a pressure measuring glow plug, the glow pin has to be electrically connected to the center pole. This is usually done with a contact spring. Within the framework of this disclosure, it was recognized that the contact spring can be a source of interference signals, which detract from the accuracy of a pressure measurement.

SUMMARY

This disclosure teaches a way of cost-effectively fabricating a pressure measuring glow plug that allows good measurements of the combustion chamber pressure, in particular of reducing impairments to measuring accuracy caused by disturbing influences of the contact spring.

In a pressure measuring glow plug according to this disclosure, the contact spring used to electrically connect the glow pin to the center pole is a U-shaped, bent strip of metal, the middle section of which has a reduced width. This simple measure makes it possible to significantly reduce the interfering influences of the contact spring on the accuracy of the pressure measurement.

This is presumably because the force exerted by the glow pin on the contact spring is as a rule not precisely oriented in the center and perfectly in an axial direction owing to installation tolerances or vibrations, so that the contact spring is not only compressed in an axial direction, but also exposed to tilting moments. The resistance offered by the contact spring to such tilting moments is reduced in a contact spring according to this disclosure, and more uniform in particular in the circumferential direction, meaning that it depends less on the direction of the tilting moment. For example, the metal strip can consist of sheet metal.

The U-shaped, bent metal strip forms a spring having two legs. When the glow pin is pushed further into the housing of the glow plug by the combustion chamber pressure, the two legs are moved toward each other. In the bent region that connects the two legs, the metal strip has its narrowest width, for example less than three fourths of its maximal width or even less than two thirds of its maximal width. The width in the bent region that connects the two legs is preferably several times as large as the thickness of the metal strip, for example at least double the thickness, in particular triple the thickness or more. Despite the reduced width in the middle section, the electrical resistance of the contact spring is still small enough to prevent any problematic heat loss from arising.

The U-shaped, bent metal strip can expand continuously from its middle section to its ends. However, it is also possible for the metal strip to expand rapidly or in one or more steps, for example by having both sides of the metal strip middle section exhibit an incision, an indentation or a notch.

One advantageous refinement of this disclosure provides that the metal strip has outwardly bent end sections. These end sections can each be used for establishing electrical contact with the center pole or the glow pin, for example via soldering or welding. The increase of the width of the metal strip toward its ends can either continue behind these bends of the end section, or also just start with the bend of the end sections.

Another advantageous refinement of this disclosure provides that the metal strip has its smallest width in the middle section. The minimal width may here remain constant in a section whose length is at least as large as its width. End sections with expanding width can then adjoin this middle section.

The measuring accuracy can be further improved by arranging the contact spring in a defined, prescribed radial orientation relative to the sensor, for example relative to a strain gauge. The glow plug thus has a marking relative to which the contact spring and sensor are oriented. For example, this marking can be a marking surface on the sensor. As a result of the reduced width of the contact spring in the bent region, the dependence of the spring constant (also called spring rate) for the contact spring on the radial orientation is reduced, but does not disappear completely. The contact spring is "softer" when loaded in a first direction in which both legs are compressed than when loaded in a direction perpendicular thereto, i.e., when tilting the glow pin perpendicular to the first direction.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
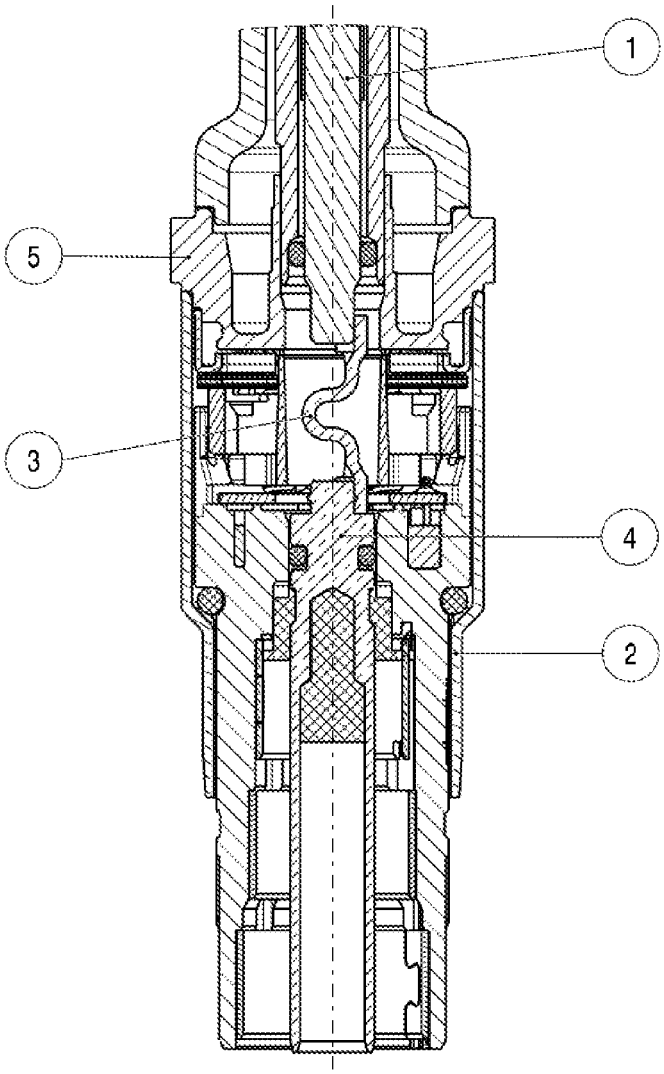
FIG. 1 is a schematic view of a pressure measuring glow plug.
Figure 5:
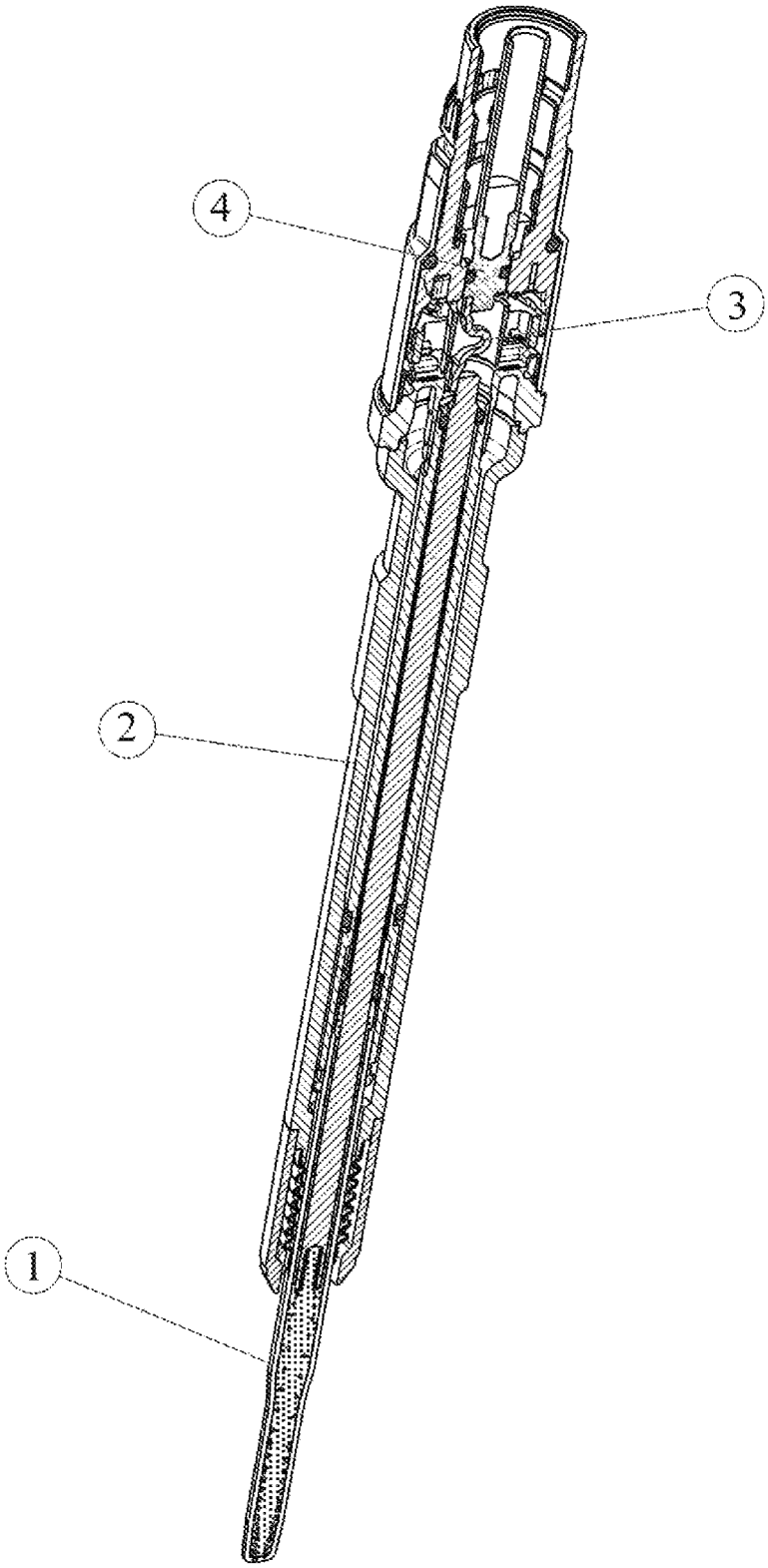
FIG. 5 is a sectional view of a pressure measuring glow plug with the contact spring shown on FIG. 4.

The glow plug schematically shown on FIGS. 1 and 5 comprises a glow pin 1, which is held in a housing 2 and can move relative to the latter in an axial direction against a restoring force. One end of the glow pin 1 here projects out of the housing 2, while its other end is electrically connected to a center pole 4 arranged in the housing 2 by means of a contact spring 3. The position of the glow pin 1 relative to the housing 2 or the pressure acting on the glow pin 1 is measured by a sensor 5, for example a piezoelectric sensor or a strain gauge.

Figure 2:
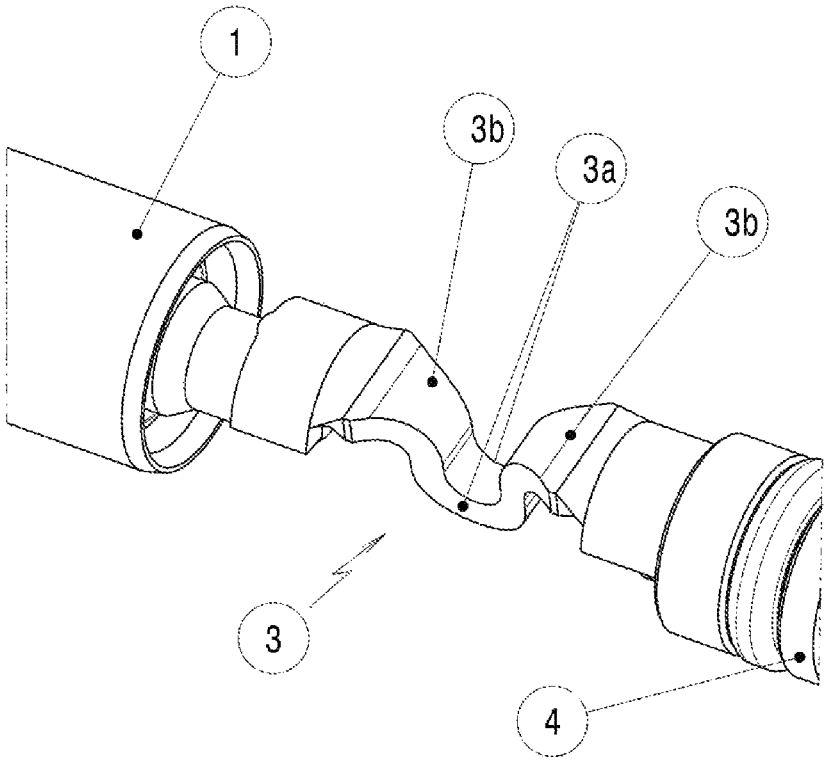
FIG. 2 is an embodiment of a contact spring, which electrically connects the glow pin to the center pole of the glow plug.

In a detailed view of the glow plug, FIG. 2 schematically depicts the contact spring 3 with an end section of the center pole 4 and an end section of the glow pin 1. The contact spring 3 is a U-shaped, bent metal strip, which has a reduced width in a middle section 3*a* and expands from the middle section 3*a* toward its two ends. In this way, the metal strip forms a spring having two legs, which are moved toward each other by pressure. The legs are connected with each other by the bent middle section 3*a* of the metal strip, and have outwardly bent end sections 3*b*.

The metal strip can broaden from the middle section 3*a* toward its two ends, either continuously or in steps, for example. The metal strip can here broaden in the bend, with which the end sections 3*b* are outwardly bent.

For example, the metal strip consists of sheet metal, and has its smallest width in the middle section 3*a*. The metal strip preferably has its minimal width in a bent section that is longer than the minimal width. The minimal width of the metal strip should not be too small, so as to prevent the electrical resistance of the contact spring from becoming so large that resistive heating leads to problems. The middle section of the metal strip preferably has a minimal width that is at least double, preferably at least triple, its thickness. As a rule, it is favorable for the metal strip to have a width measuring less than three fourths, for example less than two thirds, of its maximal width.

Figure 3:
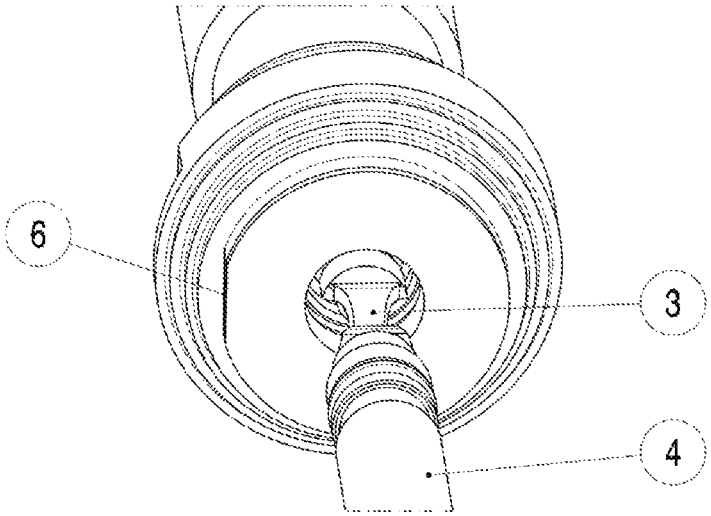
FIG. 3 is the contact spring shown on FIG. 2 with a radial orientation of the glow plug.

FIG. 3 shows the contact spring 3 together with a marking on the glow plug, relative to which the contact spring 3 is mounted with a defined orientation. In the example shown, the marking is designed as a flat surface of an otherwise circular component, wherein a narrow side of the U-shaped, bent metal strip is oriented toward this marking.

Figure 4:
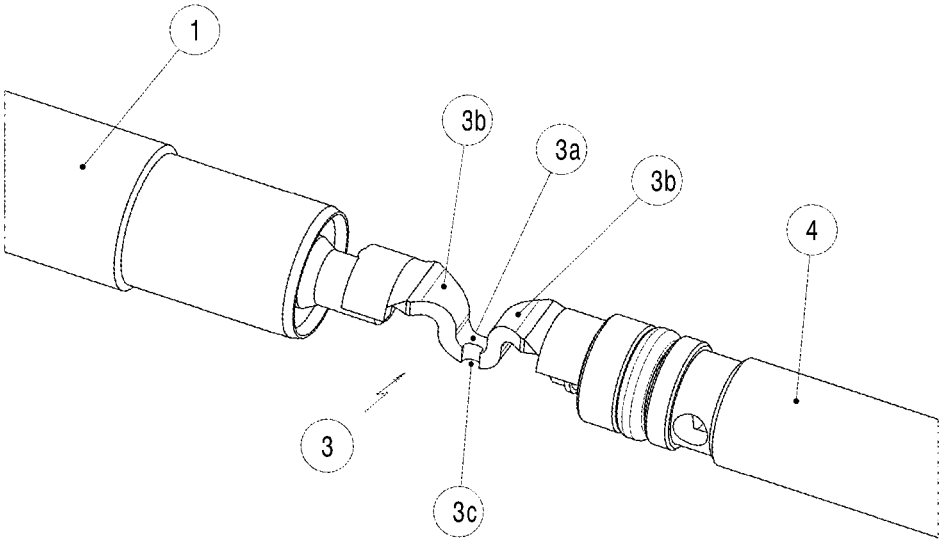
FIG. 4 is an embodiment of a contact spring, which electrically connects the glow pin to the center pole of the glow plug.

FIG. 4 shows another embodiment of a contact spring 3, which only differs from the embodiment shown on FIG. 2 in that the width is additionally reduced in the middle section 3*a* by bilateral incisions or indentations.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE LIST

1 Glow pin
2 Housing
3 Contact spring
3*a* Middle section
3*b* End section
3*c* Indentation
4 Center pole
5 Sensor
6 Marking

What is claimed is:

1. A pressure measuring glow plug, comprising:

a housing;

a glow pin projecting from the housing and displaceable in a longitudinal direction relative to the housing;

a sensor for measuring the position of the glow pin relative to the housing or for measuring pressure acting on the glow pin; and a center pole arranged in the housing and electrically connected to the glow pin via a contact spring;

wherein the contact spring is a U-shaped, bent metal strip, the bent metal strip defining a length, a width and a thickness, the length of the bent metal strip extending between two ends with a middle section between the two ends, the width extending perpendicular to the length, and the thickness extending perpendicular to both the length and the width with the thickness being smaller than the width, and wherein the middle section of the bent metal strip has a reduced width, and the width of the bent metal strip broadens from the middle section toward its two ends.

2. The pressure measuring glow plug according to claim 1, wherein the metal strip broadens continuously from the middle section towards its ends.

3. The pressure measuring glow plug according to claim 1, wherein the middle section of the metal strip has an incision or an indentation on both sides.

4. The pressure measuring glow plug according to claim 1, wherein the width of the metal strip in the middle section measures less than ¾ of the maximal width of the metal strip.

5. The pressure measuring glow plug according to claim 1, wherein the metal strip has its smallest width in the middle of its U-shaped bend.

6. The pressure measuring glow plug according claim 1, wherein the metal strip is made of sheet metal.

7. The pressure measuring glow plug according to claim 1, wherein the middle section of the metal strip has a minimal width that is at least twice as large as its thickness.

8. The pressure measuring glow plug according to claim 1, wherein the metal strip has two legs, whose end sections face away from the U-shaped bend and are outwardly bent.

9. The pressure measuring glow plug according to claim 8, wherein the outwardly bent end sections taper toward the middle section.

10. The pressure measuring glow plug according to claim 9, wherein the middle section has a constant width.

11. The pressure measuring glow plug according to claim 10, wherein the middle section has a length greater than its width.

* * * * *